United States Patent [19]

Rearwin et al.

[11] Patent Number: 4,872,324

[45] Date of Patent: Oct. 10, 1989

[54] ELASTICIZED KNITTED BAND

[75] Inventors: Earle W. Rearwin; Gayle L. Rearwin, both of Archdale, N.C.

[73] Assignee: It's A Peach, Inc., High Point, N.C.

[21] Appl. No.: 280,691

[22] Filed: Dec. 6, 1988

Related U.S. Application Data

[63] Continuation-in-part of Ser. No. 109,094, Oct. 15, 1987, abandoned.

[51] Int. Cl.[4] ..... D04B 9/46

[52] U.S. Cl. ..... 66/172 E; 66/177; 66/41

[58] Field of Search ..... 66/172 E, 177, 41

[56] References Cited

U.S. PATENT DOCUMENTS

| | | | |
|---|---|---|---|
| 2,111,353 | 3/1938 | Berry | 66/172 E |
| 2,248,900 | 7/1941 | Smith | 66/172 E |
| 2,333,870 | 11/1943 | Lawson | 66/172 E |
| 2,349,746 | 5/1944 | Morris et al. | 66/172 E |
| 2,953,003 | 9/1960 | Crawford | 66/41 |
| 3,122,906 | 3/1964 | Crawford | 66/172 E |
| 3,729,956 | 5/1973 | Nebel et al. | 60/172 E |
| 4,150,554 | 4/1979 | Cassidy | 66/177 |
| 4,445,345 | 5/1984 | Bedier | 66/177 |
| 4,663,946 | 5/1987 | Wright | 66/177 |

*Primary Examiner*—Ronald Feldbaum

*Attorney, Agent, or Firm*—Shefte, Pinckney & Sawyer

[57] ABSTRACT

A turned welt-type knitted waistband for use in pantyhose and like garments, wherein selected periodic courses in an annular region of the inward welt ply have an uncovered elastomer filament in alternate knit and float stitches for partial exposure of the float stitches for intermittent frictional contact with a wearer's body or another undergarment to assist in retaining the waistband place when worn.

16 Claims, 2 Drawing Sheets

ELASTICIZED KNITTED BAND

CROSS REFERENCE TO RELATED APPLICATION

This is a continuation-in-part of co-pending U.S. Patent Application Ser. No. 109,094, filed Oct. 15, 1987, entitled "Elasticized Knitted Band," now abandoned.

BACKGROUND OF THE INVENTION

The present invention relates generally to elasticized knitted bands and, more particularly, to such bands of a turned welt construction utilized in pantyhose and like garments.

In recent years, ladies' pantyhose garments basically a combination panty and pair of stockings unitarily formed, have become widely popular throughout the United States and elsewhere throughout the world, virtually eliminating the previously conventional use of individual stocking and garter belts or like stocking supporters. Conventionally, pantyhose garments are basically formed of a pair of tubular hosiery blanks typically knitted on a conventional circular hosiery knitting machine. Each hosiery blank is slit longitudinally at one end and the raw fabric edges exposed by the slits are seamed together along a generally U-shaped seam line.

While pantyhose garments of the above-described type provide markedly enhanced convenience and comfort to the wearer, one of the perceived problems in conventional pantyhose garments is the tendency of the typical elasticized waistband to slip down the waist and hips of the wearer, particularly as a result of bending, stooping and other moderate to strenuous physical movements many women perform repeatedly in ordinary day-to-day domestic and work activities. Typically, the elasticized waistbands of most pantyhose garments are of a conventional two-ply turned welt knitted construction having elasticized yarn, commonly a covered or uncovered latex orother elastomer yarn, knitted in single jersey stitch construction in the welt fabric. Conventional wisdom has been to address the foregoing problem by constructing the welt waistband with a more constricting and tightly-fitting elasticity to resist slippage. However, while such waistbands of course better remain in place during wearing, slippage nevertheless continues to occur and, moreover, the waistbands often tend to uncomfortably bind and constrict the wearer's waist.

SUMMARY OF THE INVENTION

It is accordingly an object of the present invention to provide an improved elasticized knitted construction for waistbands and like knitted bands utilized in pantyhose and similar garments which resists slippage during wearing by achieving enhanced frictional contact with the wearer without increased elastic constriction over conventional pantyhose waistbands and other elasticized bands.

Briefly described, the elasticized knitted band of the present invention basically has a knitted fabric body having a fabric face for facing contact with the wearer's body or undergarment and a fabric back for facing outwardly from the wearer, the fabric body comprising yarn formed in stitches extending in perpendicular courses and wales, including an uncovered elastomer yarn knitted in selected courses in alternating knit and float stitches. The float stitches appear at the fabric back of the fabric body for intermittent frictional contact with the wearer's body or undergarment through stitch interstices between the yarn of other courses to assist in retaining the band in place when worn. According to the invention, the float stitches of the uncovered elastomer yarn have a sufficient excess extent between the knit stitches of the uncovered elastomer yarn to be generally relaxed when the fabric body is stretched during wearing.

The band is preferably embodied in a pantyhose or like garment as a waistband of a turned welt construction having integrally knitted radially inward and outward annular knitted fabric plies. The inward fabric ply has an annular retaining region wherein periodic selected courses have an uncovered elastomer filament knitted in plated relation with a covered elastomer filament in knit stitches in alternate wales and float stitches in intermediate wales with the intervening nonselected courses having another yarn knitted in knit stitches in substantially every wale. The uncovered elastomer filament appears at the radially outward surface of the inward fabric ply for exposure of the float stitches of the uncovered elastomer filament through the stitch interstices of adjacent yarn courses of the inward fabric ply for intermittent frictional contact as aforesaid with the wearer's body or another undergarment. Preferably, the selected courses alternate every fourth course in the annular retaining region of the inward fabric ply. The remaining regions of the inward fabric ply and the outward fabric ply have periodic courses wherein the covered elastomer filament is knitted in knit stitches in the alternate wales and in float stitches in the intermediate wales.

DESCRIPTION OF THE PREFERRED EMBODIMENT

Figure 1:
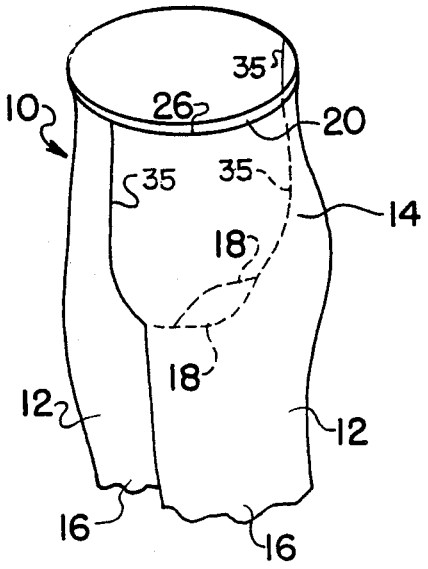
FIG. 1 is a perspective view of a typical pantyhose garment in which the elasticized knitted band of the present invention is preferably embodied.

Referring now to the accompanying drawings and initially to FIG. 1, a typical pantyhose garment of the type in which the waistband of the present invention is preferably embodied is indicated generally at 10 and basically includes a pair of individual hosiery stocking blanks 12 sewn together at the upper portions thereof to form a pair of underpanties 14 unitarily with a pair of leg stockings 16. As desired, a diamond-shaped dual-thickness crotch panel 18 may be sewn between the stocking blanks 12 in the crotch area of the underpanties 14. According to the present invention, each of the hosiery blanks 12 is formed at its respective upper end with a dual ply welt of a particular construction hereinafter described, which welts cooperate in the pantyhose garment 10 to form the elasticized waistband of the present invention annularly along the upper edge of the underpanties 14, as indicated at 20.

Figure 2:
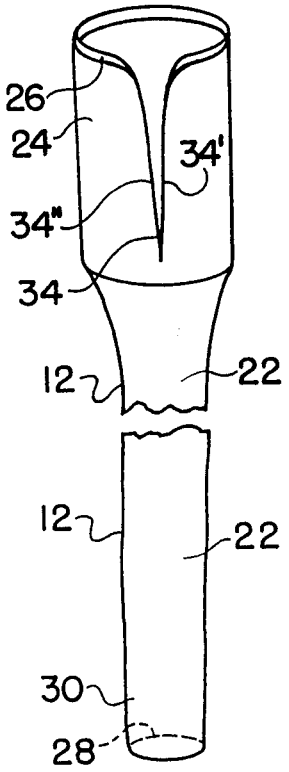
FIG. 2 is a perspective view of a typical hosiery blank for use in forming the pantyhose garment of FIG. 1.

As best seen in FIG. 2, each of the hosiery blanks 12 is of a tubular circularly-knitted construction having a tubular lower leg portion 22, a tubular upper panty portion 24 integrally knitted with the upper end of the leg portion 22, and an annular welt-type waistband portion 26 integrally knitted with the upper end of the panty portion 24. The lower end of the leg portion 22 of each hosiery blank 12 is sewn closed at 28 to form a foot portion 30 at the lower end of the leg portion 22. The present invention does not concern the construction of the leg and panty portions 22,24, which may be of any conventional knitted construction desired, preferably utilizing a typical stretchable synthetic yarn such as a texturized nylon yarn. The knitted construction of the waistband portion 26 of each hosiery blank 12 in accordance with the present invention is described more fully hereinafter.

In conventional manner, the pantyhose garment 10 is produced by initially forming an axial slit 34 in each hosiery blank 12 extending through its waistband 26 and panty portion 24, thereby exposing front and rear edges 34',34" of the slit 34. The slit 34 in each hosiery blank 12 is opened with its front and rear edges 34',34" oriented generally in line with one another in a continuous U-shape. The crotch panel 18 is sewn along one side thereof to one of the hosiery blanks 12 along the juncture of its front and rear edges 34'34". Then, the pair of hosiery blanks 12 are arranged with their respective front and rear slit edges 34',34" juxtaposed and the slit edges 34',34" are sewn together along a U-shaped seam 35, with the exposed longitudinal edge of the crotch panel 18 being sewn along the juncture of the front and rear slit edges 34',34" of the other hosiery blank 12 in the process.

In generally conventional manner, each hosiery blank 12 is preferably knitted on a circular hosiery knitting machine which may be of any suitable multi-feed type commonly known within the industry. Such knitting machines basically include a rotatable needle cylinder of a relatively small diameter with axial needle slots formed at a fine-gauge spacing from one another about the outer circumferential surface of the cylinder. A plurality of latch-type knitting needles, each having a yarn receiving hook and a closeable latch assembly, are reciprocably disposed within the axial cylinder slots. A sinker ring having a plurality of radial slots formed at compatible spacings thereabout is disposed annularly and coaxially about the upper end of the needle cylinder for synchronous rotation therewith. A plurality of loop-forming sinkers are reciprocally carried in the radial slots of the sinker ring for movement of the sinkers transversely of and between the cylinder needles. Similarly, a circular dial plate having a corresponding plurality of compatibly-spaced radial slots thereabout is disposed coaxially at the upper end of the needle cylinder to also rotate synchronously with the cylinder and sinker ring. A plurality of transfer jacks are reciprocably carried in the radial slots of the dial for movement transversely of the cylinder needles in opposition to the sinkers.

Preferably, the knitting machine has four knitting stations at which yarn feeding fingers or other feeding instruments are positioned for movement into and out of yarn feeding disposition adjacent the upper end of the needle cylinder to feed yarn to the needles and sinkers thereat. The needles, sinkers and transfer jacks are operatively manipulated within the respective slots of the cylinder, sinker ring and dial by stationary cams positioned adjacent each thereof to engage and act on cam butts formed respectively on the needles, sinkers and transfer jacks during the synchronous rotation of the needle cylinder, sinker ring and dial.

In conventional manner, the knitting machine is operable to carry out the knitting of each hosiery blank 12 from its waistband portion 26 to the foot portion 30 and an appropriate control drum or similar control arrangement of a conventional construction is provided on the machine for determining the necessary transitional changes in the machine operation to form each portion of the hosiery blank 12.

For the knitting of hosiery blanks 12 according to the present invention, the knitting machine is initially set up with one yarn feeding finger at each of the four knitting stations of the machine being equipped with an appropriate body yarn, e.g., a texturized low denier nylon yarn, for the knitting of the leg and panty portions 22,24 as well as for selective knitting in the waistband portion 26 as hereinafter described. In addition, a designated one of the knitting stations is set up with another of its yarn feeding fingers equipped with an uncovered elastomer filamentary yarn and with a third yarn feeding finger equipped with a covered elastomer yarn, for feeding operation to the needles and sinkers during the knitting of the waistband portion 26 as hereinafter described.

As used herein, the term elastomer is intended and used in a generic sense to identify any rubber or plastic material, whether synthetic or natural, having sufficient qualities of stretchability and resiliency and being suitable for formation in elongate continuous filaments for knitting, weaving or other use in the fabrication of textile fabrics. By way of example and without limitation, any common spandex filament currently in use in the knitting industry may be utilized as the uncovered elastomer yarn, such as "GLOSPAN" spandex yarn produced by Globe Manufacturing Co., "LYCRA" spandex filament produced E.I. DuPont de Nemours Co., or any other uncovered latex filament. The preferred covered elastomer yarn is of the same type of spandex filament covered by wrapping, braiding or similar manner with another yarn or fiber such as conventional core spun yarns.

In the knitting of each hosiery blank 12, the waistband portion 26 is knitted by initially activating the nylon yarn feeding finger at each knitting station and simultaneously activating and manipulating all cylinder needles, sinkers and dial transfer jacks for forming several so-called make-up single jersey stitch courses on the transfer jacks, whereupon the jacks are withdrawn into the dial and deactivated until the completion of the welt construction of the waistband, all in conventional manner. Following completion of the make-up courses on the transfer jacks, the nylon yarn feeding finger at the one designated knitting station is taken out of feeding operation and the feeding finger carrying the covered elastomer filament is activated for feeding operation. As the rotation of the needle cylinder and sinker ring continues, only every alternate cylinder needle and the alternating sinkers associated therewith are activated and manipulated at the one designated knitting station, while all cylinder needles and sinkers continue to be activated and manipulated at the other three knitting stations. Accordingly, during each subsequent revolution of the needle cylinder and sinker ring, three successive courses of nylon body yarn are formed in single jersey stitch construction followed by one course of the covered elastomer yarn formed in jersey stitches in alternate needle wales and float stitches across intermediate needle wales. This manner of operation is continued for a predetermined number of revolutions of the needle cylinder and sinker ring, e.g. seven revolutions sufficient to form twenty-eight fabric courses.

Thereupon, the yarn feeding finger at the one designated knitting station carrying the uncovered elastomer filament is activated into yarn feeding position while the yarn feeding finger carrying the covered elastomer at the designated station is maintained in feeding operation for simultaneous feeding of both elastomer yarns. Needle manipulation at the four knitting stations continues identicaly as in the immediately preceding revolutions of the needle cylinder and sinker ring. Accordingly, during each continuing revolution of the needle cylinder and sinker ring, three successive nylon body yarn courses are formed each of a single jersey stitch construction followed by one course of the covered and uncovered elastomer yarns formed in plated relationship in jersey stitches in alternate needle wales and in float stitches across the intermediate needle wales. This manner of operation is continued for a predetermined number of revolutions of the needle cylinder and sinker ring, e.g. seven revolutions thereby forming twenty-eight successive fabric courses in total. During this operating condition of the knitting machine, the uncovered elastomer filament is fed under an essentially minimal amount of tensioning just sufficient to insure proper placement of the filament on the needles and at a greater rate of feeding than the companion covered elastomer yarn. In this manner an excess length of the uncovered elastomer filament is knitted into the fabric structure in a substantially untensioned, i.e. relaxed, condition so that the uncovered elastomer filament does not contribute to the elastic contractability of the waistband fabric and instead remains in a substantially untensioned, relaxed condition during normal wearing and handling of the pantyhose 10, as more fully described hereinafter.

Following the completion of the predetermined number of cylinder and sinker ring revolutions, the knitting machine is returned to the preceding operating condition wherein the one designated knitting station has only its yarn feeding finger carrying the covered elastomer yarn in feeding position with the nylon yarn feeding finger and the yarn feeding finger carrying the uncovered elastomer yarn out of feeding operation. Manipulation of the needles and sinkers continues identically as during all of the cylinder and sinker ring revolutions subsequent to the make-up courses. This operating condition of the machine then continues for approximately the same number of machine revolutions previously occurring since the completion of the make-up courses, e.g. fourteen revolutions, thereby to form substantially the same fabric extent as already knitted in a repeating pattern of three successive nylon yarn jersey stitch courses alternating with one intervening covered elastomer course in alternating jersey and float stitches.

Following the completion of such revolutions of the cylinder and sinker ring, the yarn feeding finger carrying the covered elastomer yarn at the one aforesaid knitting station is removed from feeding operation and replaced by the nylon yarn feeding finger and, simultaneously, the transfer jacks in the dial are reactivated to return the make-up courses onto the cylinder needles. Thus, as the needle cylinder and sinker ring revolutions continue thereafter, the welt construction of the waistband portion 26 is completed and the formation of the panty portion 24 and, subsequently, the lower leg portion 22 progresses in a conventional fashion.

Figure 3:
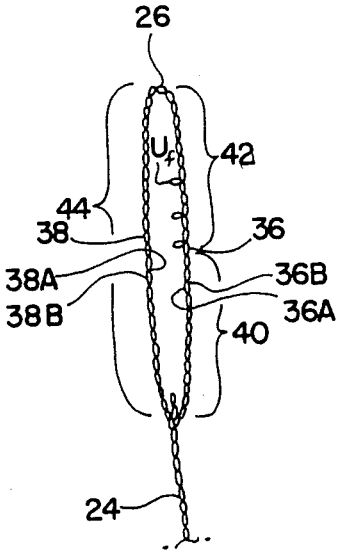
FIG. 3 is a diagrammatic vertical sectional view through the waistband of the pantyhose garment of FIG. 1.

As will thus be understood, the waistband portion 26 of each hosiery blank 12 is of a two-ply inturned welt construction as diagrammatically represented schematically in FIG. 3, having a radially inwardly facing fabric ply 36 formed during the initial fourteen (or other predetermined number) revolutions of the needle cylinder and sinker ring in the formation of the waistband welt following the completion of the initial make-up courses and a radially outwardly facing fabric ply 38 formed during the succeeding fourteen cylinder and sinker ring revolutions in the formation of the waistband welt. As will further be understood, the above-described group of yarn courses initially formed immediately following the make-up courses wherein three succeeding nylon jersey courses alternate repetitively with a single intervening covered elastomer course of alternating jersey and float stitches, appears in the radially inward ply 36 at its region adjacentmost the panty portion 24, as indicated at 40 in FIG. 3. The subsequently-formed group of yarn courses wherein three succeeding nylon jersey courses alternate according to the same pattern with a single intervening plated course of covered and uncovered elastomer filaments in the same alternating jersey and float stitch construction, also appears in the radially inwardly facing ply 36 at the annular region thereof along the upper edge of the waistband portion 26, as indicated at 42 in FIG. 3. The succeedingly formed group of yarn courses identical in repeating pattern to the courses of region 40 occupy the entire radially outward ply 38, as indicated at 44 in FIG. 3.

Figure 4:
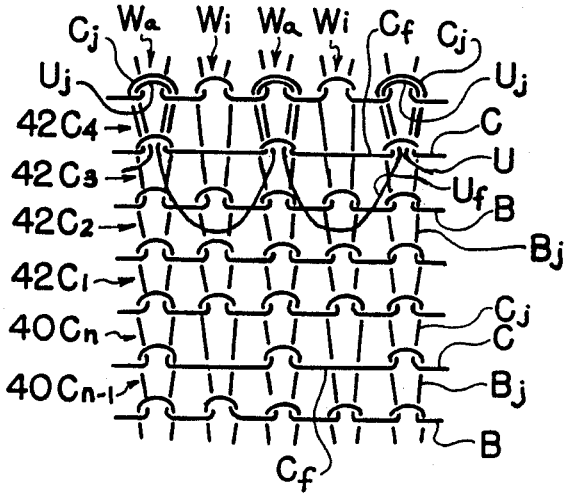
FIG. 4 is a diagrammatic elevational view of the knitted structure of the radially inward ply of the waistband of FIG. 3 in accordance with the preferred embodiment of the present invention, as viewed from the radially outwardly facing technical back of the inward ply when the waistband is in an unstretched condition.
Figure 5:
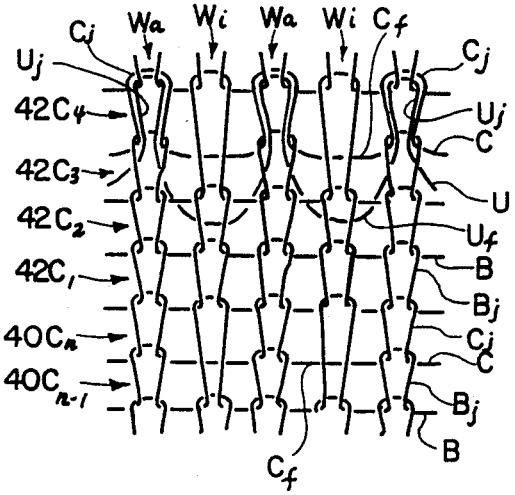
FIG. 5 is a diagrammatic elevational view of the knitted structure of the radially inward ply of the waistband of FIG. 3, as viewed from the opposite radially inwardly facing technical face of the inward ply when the waistband is in an unstretched condition.
Figure 6:
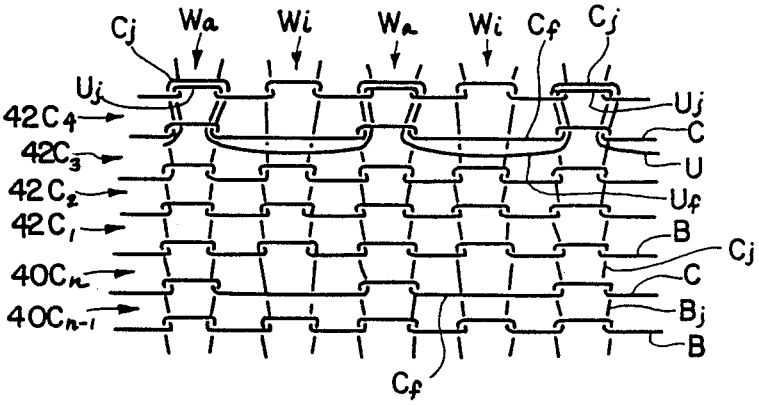
FIG. 6 is another diagrammatic elevational view of the technical back of the radially inward waistband ply of FIG. 4, representing a coursewise stretched condition of the waistband as when worn.
Figure 7:
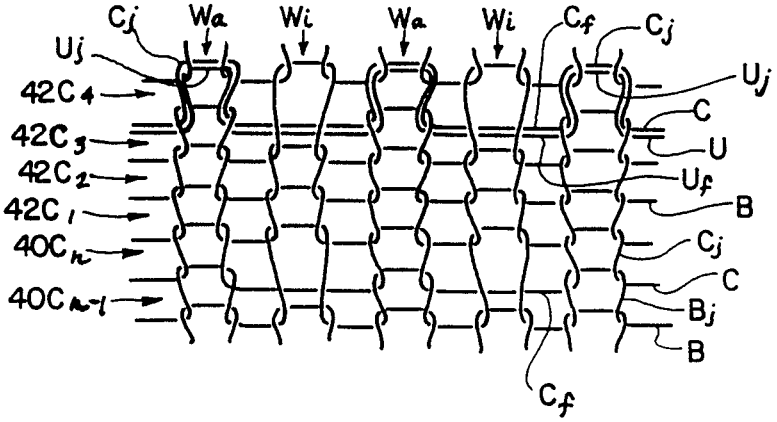
FIG. 7 is another diagrammatic elevational view of the technical face of the radially inward waistband ply of FIG. 5, representing a coursewise stretched condition of the waistband as when worn.

Referring now to FIG. 4–7, the knitted construction of the inward ply 36 is diagrammatically illustrated in elevation across several courses of the annular regions 40,42. As will be understood by those persons skilled in the art, the technical reverse, or so-called back or "purl", side of the knitted fabric in the waistband portion 26 appears at the unexposed surfaces 36A, 38A of both the inward and outward fabric plies 36,38 within the enclosed interior of the welt construction, while the technical face side of the knitted fabric in the waistband portion 26 appears at the exposed surfaces 36B, 38B of both the inward and outward fabric plies 36,38. FIGS. 4 and 6 accordingly depict the knitted structure of the inward ply 36 as appearing at the unexposed radially outwardly facing technical fabric back of surface 36A, respectively in relaxed (FIG. 4) and stretched (FIG. 6) conditions. Likewise, FIGS. 5 and 7 depict the same knitted structure of the inward ply 36 as appearing at the exposed radially inwardly facing technical fabric face of surface 36B, respectively in relaxed (FIG. 5) and stretched (FIG. 6) conditions.

In each figure, courses $40C_n$ and $40C_{n-1}$ represent the final two courses knitted in the region 40, course $40C_{n-1}$ representing a nylon jersey stitch course having the nylon body yarn B knitted in jersey knit stitches $B_j$ in every axial wale $W_a$, $W_i$ throughout the circumferential extent of the waistband portion 26 and course $40C_n$ representing a covered elastomer yarn course having the covered elastomer filament C formed in jersey knit stitches $C_j$ in alternate fabric wales $W_a$ and in intervening float stitches $C_f$ across the intermediate wales $W_i$ throughout the circumferential extent of the waistband portion 26. Similarly, courses $42C_1$ through $42C_4$ represent the first four fabric courses of the repeating course pattern through the region 42 of the inward ply 36, courses $42C_1$ through $42C_3$ representing nylon jersey courses identical to the nylon courses of the region 40 such as course $40C_{n-1}$, and course $42C_4$ representing the plated courses of the region 42 having the covered elastomer yarn C and the uncovered elastomer yarn U knitted in plated relationship in respective jersey knit stitches $C_j$,$U_j$ in every alternate wale $W_a$ and in respective float stitches $C_f$,$U_f$ extending across every intermediate fabric wale $W_i$ throughout the circumferential extent of the waistband portion 26. Notably, the float stitches $U_f$ of the uncovered elastomer filament U have an excess length intermediate the knit stitches $U_j$ of the uncovered elastomer filament U, as a result of the overfeeding of the filament U in a minimally tensioned state as above described, so that the float stitches $U_f$ form into relaxed generally elongated pile-like loops which extend somewhat from the surface 36A of the inward ply 36 (see FIG. 3) when the waistband is relaxed, as shown in FIGS. 4 and 5, and remain substantially relaxed and untensioned even when the waistband is stretched during wearing, as shown in FIGS. 6 and 7.

The knitted construction of the plated courses in the region 42 of the inward welt ply 36 provides the waistband portion 26, and in turn the waistband 20 in pantyhose and like garments in which such waistband portions are incorporated, with distinct and unique advantages over conventional knitted waistband constructions. As will be understood, the elastomeric material of which the uncovered elastomer filament is constituted has a frictional character which produces at least some frictional force when in contact with other surfaces, and the friction so created can be significant when contact occurs with the elastomeric material in a tensioned state. As will be further understood, the float stitches $U_f$ of the uncovered elastomer filament U produced by the alternating float construction of the plated elastomer filament courses in the region 42 of the inward welt ply 36 although not directly exposed at the radially inwardly facing technical face surface 36B of the inward ply 36, nevertheless are partially exposed to such side of the inward ply 36 through the interstices in the stitches of the body yarn B in adjacent fabric courses, such as course $42C_3$, particularly in the stretched condition of the waistband as seen in FIGS. 6 and 7. Accordingly, when the pantyhose 10 is worn, the partial exposure of the uncovered elastomer filament floats $U_f$ at the radially inward side of the waistband 20 come into intermittent frictional contact either with the wearer's skin at the waist or with another undergarment if worn by the wearer, such as a pair of panties as ordinarily worn by women beneath a pantyhose garment. However, since the uncovered elastomer floats $U_f$ remain in a substantially relaxed, untensioned condition even when the waistband is stretched during wearing, the frictional forces thusly created by the uncovered elastomer floats $U_f$ are not so substantial as to create binding or discomfort of the wearer but instead are just sufficient to substantially resist any tendency of the waistband 20 to shift or slip during wearing as a result of the physical activities of the wearer, in significant contrast to conventional pantyhose waistbands. As an attendant advantage, the waistband 20 may be less elastically constricting and binding than conventional pantyhose while still achieving an improved ability to remain in place when worn, thereby providing enhanced comfort for the wearer without sacrificing a firm fit.

It will therefore by readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. For example and without limitation, the present invention may be embodied in waistbands in many garments other than pantyhose as well as in knitted bands having other uses in other garments such as in elastic tops for socks and hosiery, elastic cuffs, elastic shoulder straps in brassieres, slips and the like. Further, it is contemplated that elastic bands according to the present invention may be equivalently fabricated by warp knitting machinery and methods as well as by circular or weft knitting as above described. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An elasticized knitted band for use as a waistband or the like in pantyhose and other garments, said band having a knitted fabric body having a fabric face for facing contact with a wearer's body or undergarment and a fabric back for facing outwardly from the wearer, said fabric body comprising yarn formed in stitches extending in perpendicular courses and wales including an uncovered elastomer yarn knitted in selected courses in alternating knit and float stitches with the float stitches appearing at said fabric back of said fabric body for intermittent frictional contact with the wearer's body or undergarment through stitch interstices between said yarn of other courses, said float stitches of said uncovered elastomer yarn having a sufficient excess extent between said knit stitches of said uncovered elastomer yarn to be generally relaxed when said fabric body is stretched during wearing.

2. An elasticized knitted band according to claim 1 and characterized further in that said knit stitches in each selected course are formed in alternate wales and said float stitches in each selected course are formed in the intermediate wales.

3. An elasticized knitted band according to claim 1 and characterized further in that a predominant number of the non-selected courses have yarn knitted in knit stitches in substantially every wale.

4. An elasticized knitted band according to claim 1 and characterized further in that said selected courses include every fourth course in one region of said band.

5. An elasticized knitted band according to claim 1 and characterized further in that each said selected course includes another yarn knitted in plated relationship with said uncovered elastomer yarn.

6. An elasticized knitted band according to claim 5 and characterized further in that said another yarn is a covered elastomer yarn.

7. An elasticized knitted band according to claim 1 and characterized further in that some of the non-selected courses include a covered elastomer yarn knitted in alternating knit and float stitches.

8. In a pantyhose garment or a like garment, an elasticized knitted waistband of a turned welt construction having radially inward and outward annular fabric plies integrally knitted of yarn extending in circumferential courses and axial wales, said inward fabric ply having a radially inward fabric face for facing contact with a wearer's body or another undergarment and a radially outward fabric back for facing outwardly from the wearer, said inward fabric ply comprising an uncovered elastomer yarn knitted in periodic selected courses in alternating knit and float stitches with the float stitches appearing at the radially outward fabric back of said inward fabric ply for intermittent frictional contact with the wearer's body or undergarment through stitch interstices between said yarn of other courses to assist in retaining said waistband in place when worn, said float stitches of said uncovered elastomer yarn having a sufficient excess extent between said knit stitches of said uncovered elastomer yarn to be generally relaxed when said waistband is stretched during wearing.

9. An elasticized knitted waistband in a pantyhose garment or a like garment according to claim 8 and characterized further in that said knit stitches in each selected course are formed in alternate wales and said float stitches in each selected course are formed in the intermediate wales.

10. An elasticized knitted waistband in a pantyhose garment or a like garment according to claim 8 and characterized further in that a predominant number of the non-selected courses of said inward fabric ply intervening and adjacent said selected courses have yarn knitted in knit stitches in substantially every wale.

11. An elasticized knitted waistband in a pantyhose garment or a like garment according to claim 8 and characterized further in that said selected courses include every fourth course in an annular retaining region of said inward fabric ply.

12. An elasticized knitted waistband in a pantyhose garment or a like garment according to claim 8 and characterized further in that each said selected course includes another yarn knitted in plated relationship with said uncovered elastomer yarn.

13. An elasticized knitted waistband in a pantyhose garment or a like garment according to claim 8 and characterized further in that said another yarn is a covered elastomer yarn.

14. An elasticized knitted waistband in a pantyhose garment or a like garment according to claim 8 and characterized further in that some of the non-selected courses include a covered elastomer yarn knitted in alternating knit and float stitches.

15. In a pantyhose garment or a like garment, an elasticized knitted waistband of a turned welt construction having radially inward and outward annular fabric plies integrally knitted of yarn extending in circumferential courses and axial wales, said inward fabric ply having a radially inward fabric face for facing contact with a wearer's body or another undergarment and a radially outward fabric face for facing outwardly from the wearer, said inward fabric ply having an annular retaining region wherein periodic selected courses have an uncovered elastomer filament knitted in plated relation with a covered elastomer filament in knit stitches in alternate wales and float stitches in intermediate wales and the intervening non-selected courses have another yarn knitted in knit stitches in substantially every wale, said uncovered elastomer filament appearing at the radially outward fabric back of said inward fabric ply for exposure of said float stitches of said uncovered elastomer filament through stitch interstices between said another yarn of adjacent courses for intermittent frictional contact with the wearer's body or undergarment to assist in retaining said waistband in place when worn, said float stitches of said uncovered elastomer filament courses having a sufficient excess extent between said knit stitches of said uncovered elastomer filament to be generally relaxed when said waistband is stretched during wearing.

16. An elasticized knitted waistband in a pantyhose garment or a like garment according to claim 15 and characterized further in that the remaining regions of said inward fabric ply and said outward fabric ply have periodic courses wherein said covered elastomer filament is knitted in knit stitches in said alternate wales and in float stitches in said intermediate wales.

* * * * *